US009832830B2

(12) United States Patent
Oepts et al.

(10) Patent No.: US 9,832,830 B2
(45) Date of Patent: Nov. 28, 2017

(54) SOLID STATE LIGHTING MODULE, A LIGHTING CIRCUIT AND LIGHTING CONTROL METHODS

(71) Applicant: PHILIPS LIGHTING HOLDING B.V., Eindhoven (NL)

(72) Inventors: Wouter Oepts, Eindhoven (NL); Haibo Qiao, Eindhoven (NL); Duo L. Li, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/136,367

(22) Filed: Apr. 22, 2016

(65) Prior Publication Data

US 2016/0316536 A1 Oct. 27, 2016

(30) Foreign Application Priority Data

Apr. 24, 2015 (WO) ..... PCT/CN2015/077404
Jul. 22, 2015 (EP) ..... 15177862

(51) Int. Cl.
*H05B 33/08* (2006.01)
*H05B 37/02* (2006.01)

(52) U.S. Cl.
CPC ..... *H05B 33/0851* (2013.01); *H05B 33/0845* (2013.01); *H05B 37/0245* (2013.01); *H05B 37/0272* (2013.01)

(58) Field of Classification Search
CPC combination set(s) only.
See application file for complete search history.

(56) References Cited

U.S. PATENT DOCUMENTS

| | | | |
|---|---|---|---|
| 2014/0176015 | A1 | 6/2014 | Suzuki |
| 2015/0022106 | A1 | 1/2015 | Chiu |
| 2015/0377437 | A1 | 12/2015 | Austerer et al. |

FOREIGN PATENT DOCUMENTS

| | | | |
|---|---|---|---|
| DE | 102013202282 | A1 | 8/2014 |
| DE | 102013226964 | A1 | 6/2015 |
| WO | WO2013072784 | A1 | 5/2013 |
| WO | WO2013186655 | A2 | 12/2013 |
| WO | WO2014001987 | A2 | 1/2014 |
| WO | WO2015074881 | A1 | 5/2015 |

*Primary Examiner* — Douglas W Owens
*Assistant Examiner* — Jianzi Chen
(74) *Attorney, Agent, or Firm* — Akarsh P. Belagodu

(57) ABSTRACT

A solid state lighting module is disclosed. In one example, the module comprises a light source and a resistor circuit, wherein an output resistance of the resistor circuit is for conveying to a connected driver information on a desired power to be applied to the solid state light source. A control interface is provided for receiving configuration information from an external configuration device and a control circuit configures the resistor circuit thereby to set the output resistance in response to received configuration information. This approach involves integrating the configuration function in the lighting module instead of in the driver. The output resistance can be determined by existing driver architectures without modification, while at the same time the ability of the user to tailor individual lighting modules to their needs is enabled.

14 Claims, 3 Drawing Sheets

SOLID STATE LIGHTING MODULE, A LIGHTING CIRCUIT AND LIGHTING CONTROL METHODS

FIELD OF THE TECHNOLOGY

This invention relates to the control of a lighting unit.

BACKGROUND

LED lighting is transforming the lighting industry, such that light products are no longer merely on/off devices, but have become sophisticated devices with more elaborate control options, made possible by the easy controllability of LEDs.

The required current to be supplied by a driver circuit varies for different lighting units/modules, and for different configurations of lighting unit. The latest LED driver circuits are designed to have sufficient flexibility that they can be used for a wide range of different lighting units, and for a range of numbers of lighting units. For this purpose, an intelligent electronic driver circuit in a LED lighting fixture (often called "ballast") is now frequently separate from the lighting module itself, to enable this flexibility in the design of a lighting system.

It is known for the driver circuit to operate within a so-called "operating window". An operating window defines a relationship between the output voltage and output current that can be delivered by the driver circuit. Providing the requirements of a particular lighting load fall within this operating window, the driver circuit is able to be configured for use with that particular lighting load, giving the desired driver circuit flexibility. This means a driver circuit is able to be used for LED units of different design and from different manufacturers and for a wide range of applications, providing that the required current and voltage setting fits the operating window. It also enables lighting generation upgrades without changing the driver circuit.

The driver circuit needs to have its output current set to the desired level within its operating window. This can be achieved by programming the driver circuit to deliver a specific current.

However, an alternative solution which enables a less complicated interface for the user is to provide current setting using a setting component, such as a resistor, outside the driver circuit. This resistor can for example be placed on a PCB which provides the interface between the driver circuit and the LED terminals, or the resistor can be integrated as part of a connection cable or connector unit. The value of the resistance is detected for subsequent control of the output of the driver circuit.

The value of the current setting resistor (or other component) influences the behavior of the driver circuit, which can then be used to configure its output accordingly, so that the output current is determined by the resistance value. Once the current has been set, the voltage delivered by the driver circuit will vary depending on the load presented to it (since the LEDs are current driven), but the driver circuit will maintain this voltage within the operating window.

A lighting module of this type is referred to as an analog module, and there is an analog interface, with the lighting module having a passive component with a value which indicates its power requirement. The average LED current is controlled and the LED current is maintained continuously. The driver circuit is for example based on a switched mode power converter architecture.

This known system does not allow the end user to change the current (and light output flux) of the lighting module. If a different current is needed, the setting resistor needs to be modified. Typically, the current setting resistor of the module cannot be changed by the customer.

When a customer uses lighting modules to build luminaires, there is often a need to optimize the luminaire to their preference, without being restricted to a fixed light output, temperature or power. For instance, an optical design may require less light output from the module. Alternatively, because a heat sink has been miniaturized, the module may run at too high temperature based on the default setting of the current setting resistor, and a reduced power is needed.

Hence, there is a need for the customer to be able to flexibly set the output current. One known solution is for the customer to apply a suitable current setting resistor into the driver. The driver then uses this component to define the output current.

An alternative to placing a setting resistor in the driver is to have a remotely settable drive current, which involves wireless communication with the driver to program the driver. The drive current is then set by the driver and no additional components in the lighting module are required.

The disadvantage of this approach is that the portfolio of drivers needs to be upgraded. This portfolio consists of many driver types (fixed output, dimming, DALI dimming, different housings, different power).

This means the implementation of the improved system will be slow and costly.

SUMMARY

It would be advantageous to achieve a flexible driver setting in a way which can be implemented with minimum disruption to existing lighting infrastructure, such as not influencing the existed driver portfolio/installation. Examples according to an aspect of the invention provide a solid state lighting module, comprising: a solid state light source; a resistor circuit, wherein an output resistance of the resistor circuit is for conveying to a connected driver information on a desired power to be applied to the solid state light source; a control interface for receiving configuration information from an external configuration device; and a control circuit for controlling a configuration of the resistor circuit thereby to set the output resistance in response to received configuration information.

This approach involves integrating the configuration function in the lighting module instead of in the driver. The output resistance can be adapted within the lighting module, and then determined by existing driver architectures without modification, while at the same time the ability of the user to tailor individual lighting modules to their needs is enabled. The driver portfolio thus does not have to change.

The output resistance of the resistor circuit is independent of light source drive signals from the connected driver to power the solid state light source. Thus, the resistor circuit is not part of a power (or current) sensing arrangement for feedback control of the driver. The resistor circuit is used to convey information on a desired power level rather than providing feedback information. The resistor circuit is for conveying the information on the desired power according to the manufacturer design of the LED module design or a user's preference, rather than conveying information about actual power delivered to the light source.

The control interface may comprise a NFC receiver, comprising a NFC antenna and a NFC receiver circuit. Thus, the lighting module may be configured wirelessly by a NFC configuration device of the end customer.

Since the control circuit is normally an active circuit with active components such as active switches, it needs power. To meet this requirement, a power supply circuit may be provided for generating a power supply for the control circuit from light source drive signals received from a connected driver. Thus, the lighting module does not require a dedicate power source, but can extract any required power from the lighting signal (i.e. the drive current).

The power supply circuit may for example comprise a transistor circuit having an output transistor and a threshold element applied to the control terminal of the output transistor thereby to set an output voltage of the output transistor. This defines a linear approach, and it may be used when the lighting unit voltage (e.g. the LED string voltage) is greater than the required supply voltage for the control interface. The advantage of this example is low cost due to the simplicity of the linear power supply.

Another example of power supply circuit is a switch mode power supply circuit. This can also generate a supply voltage from a current input tapped from the lighting unit terminals. The advantage of this example is the switched mode power supply provides a high efficiency and low power loss.

Another example of power supply circuit is a voltage line in parallel with a certain number of solid state light sources wherein a forward voltage of said certain number of solid state light sources corresponds to an output voltage as the power supply. The advantage of this example is low cost while high efficiency since the solid state light source provides a stable forward voltage across itself.

The NFC receiver may comprise a power harvesting circuit may be provided for generating a power supply for the control interface from a wireless signal received from the external configuration device. Thus, the external configuration device may provide the required power wirelessly.

The output resistance may be defined between:

a ground terminal of the module and a resistor output terminal; or a light source terminal of the module and a resistor output terminal.

These give two options for different configurations of the current setting resistor (known in the industry as RSET2 and RSET3). In the first option, the interface for conveying the output resistance may be totally different from the power interface to drive the light source. In the second option, the output resistance may share one terminal of the light source, such as using a common ground terminal.

In a first example, the resistor circuit comprises a set of resistor branches, each comprising a resistor and a switch in series, and the branches being in parallel, wherein the control circuit is adapted to control the settings of the switches thereby defining the configuration of the resistor circuit.

In this way, an electronically controlled variable resistor is defined, with a discrete number of resistor settings.

In a second example, the resistor circuit comprises first and second terminals for connection to the driver, wherein the resistor circuit comprises:

a current sensor for sensing the current flowing between the first and second terminals; and a voltage sensor for sensing the voltage between the first and second terminals, wherein the control circuit comprises:

a unit for calculating the equivalent resistance of the resistor circuit according to the sensed voltage and the sensed current; and a switching circuit between the first and second terminals for controlling the equivalent resistance using the configuration information as well as the calculated equivalent resistance.

This defines a feedback mechanism for controlling the effective resistance presented, namely mimicking a resistor with the effective resistance. The switching circuit may comprise a transistor which operates in a linear control mode. According to the sensed voltage and current, the transistor base (or gate) may be dynamically regulated. This sets the equivalent resistance to the desired level.

In a third example, the resistor circuit comprises first and second terminals for connection to the driver and for receiving a voltage, wherein the resistor circuit comprises a current sensor for sensing the current flowing between the first and second terminals, wherein the control circuit comprises a current control unit for controlling the current through the resistor circuit using the configuration information as well as feedback of the sensed current.

The circuit functions as a current source, and the current delivered is interpreted by the driver. Again, a feedback mechanism is defined for controlling the effective resistance presented by providing control of the current delivered.

The control methods may be based on analogue or digital control.

However, there is a microcontroller for the NFC function, so some digital signal processing may be implemented by the microcontroller without incurring additional cost.

The module may further comprise a temperature sensor for sensing temperature, wherein the control circuit is adapted for controlling the configuration of the resistor circuit thereby to set the output resistance further in response to the sensed temperature.

In this way, a thermal function can be built into the module. This for example allows the possibility to program the module to stay below a maximum temperature (equal to a minimum lifetime).

The driver will for example continuously measure the current setting resistor, so that any time the current setting resistor value is changed, the driver will respond by changing its output current.

The control interface may be adapted to receive the configuration information before the module is driven by the connected driver. This enables the module to be configured in a factory or during installation.

The invention also provides a lighting module system comprising:

a lighting module as defined above; and a configuration device for sending configuration information to the control interface of the lighting module, thereby to write a desired power setting of the lighting module therein.

This configuration device may be used by the end user when determining how to use the lighting module.

The desired power for example comprises the rated power of the lighting module. This rated power defines the normal current/power that is required by the lighting module. The lighting module requires a current or a current window which defines the rated power.

The invention also provides a lighting circuit comprising: a lighting module as defined above; and a driver, wherein the driver comprises: a power unit for providing power to the lighting module; a sensing unit for coupling to the resistor circuit for detecting the output resistance; and a controller for controlling the power applied to the lighting module by the power unit in dependence on the information on the desired power conveyed by the detected output resistance.

The driver may comprise: a feedback loop independent from said resistor network, for sensing the actual light source drive signals provided by the power unit to the lighting module and providing the sensed light source drive signals to the controller, wherein said controller of the driver is further adapted to control the light source drive signals provided by the power unit according to the rated power of the lighting module and the sensed light source drive signals.

The invention also provides a method of controlling a solid state lighting module which comprises a solid state light source and a resistor circuit, wherein an output resistance of the resistor circuit is for conveying to a connected driver information on a desired power to be applied to the solid state light source, wherein the method comprises: sending configuration information from a configuration device to the lighting module; and within the lighting module, controlling a configuration of the resistor circuit thereby to set the output resistance in response to received configuration information.

A solid state lighting module may be driven by: controlling the solid state lighting module using the controlling method defined above; using a driver connected to the solid state lighting module to determine the output resistance; and using the driver to control the power applied to the lighting module in dependence on the determined output resistance.

BRIEF DESCRIPTION OF THE DRAWINGS

Examples will now be described in detail with reference to the accompanying drawings, in which.

DETAILED DESCRIPTION OF THE EMBODIMENTS

The various embodiments provide a solid state lighting module, comprising a solid state light source and a resistor circuit, wherein an output resistance of the resistor circuit is for conveying to a connected driver information on a desired power to be applied to the solid state light source. A control interface is provided for receiving configuration information from an external configuration device; and a control circuit configures the resistor circuit thereby to set the output resistance in response to received configuration information. This approach involves integrating the configuration function in the lighting module instead of in the driver. The output resistance can be determined by existing driver architectures without modification, while at the same time the ability of the user to tailor individual lighting modules to their needs is enabled.

Down lighting and accent lighting solutions are typically based on LED modules, where each module combines a LED light engine and an LED driver. The light engine may for example be based on Chip on Board (CoB) LEDs. Holders are used to mount the CoB LEDs and a cable passes from the holder to the driver. The total system thus consists of a driver, cable and light engine.

As explained above, driver flexibility means that there is a large range of drivers that can drive the same light engine. For instance there are fixed output current drivers, dimming drivers and programmable drivers. There are also different housing types.

It has been proposed to incorporate a small PCB as part of the holder, and the PCB can then include passive current setting components.

Different light engine may require different operation current. The PCB may for example provide a circuit that allows the driver to sense the temperature of the module as well as having a setting resistor used by the driver to know and set the correct current.

Figure 1:
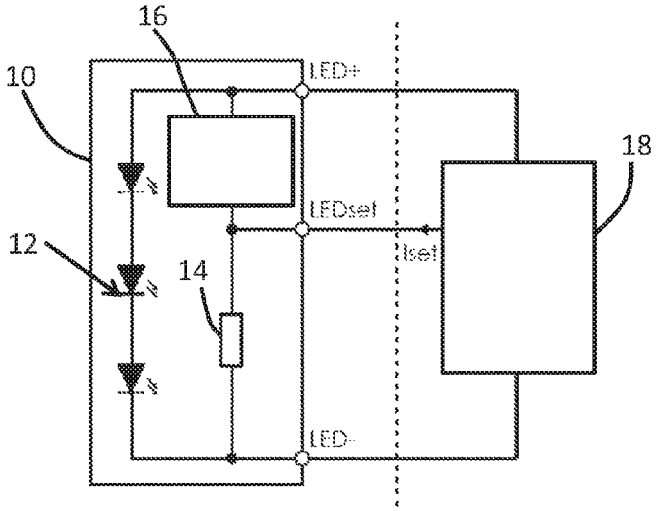
FIG. 1 shows a known example of LED module and driver using a current setting resistor in the LED module.

A simple schematic of this function is shown in FIG. 1. The LED module 10 comprises the light engine 12 (i.e. the LED string), a current setting resistor 14 and a thermal protection circuit 16. The module 10 connects to a driver 18 using only three terminals. Terminals LED+ and LED− connect to the ends of the LED string 12, and a third terminal LEDset enables the driver 18 to measure the resistance of the current setting resistor 14 by injecting a measurement current Iset. With a certain resistance of the current setting resistor in the LED module, a certain voltage occurs across the setting resistor and is detected by the driver 18, and in turn the driver 18 is aware of how much current/power the LED module requires.

This arrangement does not allow the end user to change the current (and therefore light output flux) of the light module 10. If a different current is needed, the setting resistor 14 needs to be modified.

A customer using the modules to build luminaires may desire to optimize their luminaire light output to their preferences, without being limited to a fixed light output, temperature or power. For instance, their own optical design may require less light output from the module. Alternatively, due to the use of a miniaturized heat sink, a reduced power may be desired to prevent the module reaching too high temperatures.

The desire for the customer to be able to flexibly set the output current has been recognized. For example, a setting resistor may be inserted into the driver by the customer. The driver then uses this setting resistor to define the output current.

An alternative to placing a current setting resistor in a driver is to enable a remotely settable drive current. For example, by using near field communication (NFC) a driver can be programmed using a NFC reader. Philips (Trade Mark) is releasing a system which operates in this way, named the "SimpleSet" (Trade Mark) range. This wireless programming technology allows the luminaire manufacturers to quickly and easily program the LED driver at any stage during the manufacturing process, without a connection to mains power, offering great flexibility.

With this "SimpleSet" system, the driver current is set via the driver and no additional components in the module are required. This approach is thus based on a new and upgraded driver design, and it is therefore particularly suitable for new lighting installations.

There are many existing driver types (fixed output, dimming, DALI dimming, different power levels etc.). It would be desirable in existing installations to be able to use existing drivers to implement the simplified output flux control, for example by changing the lighting module instead of changing the driver.

The invention is based on the integration of configuration functionality in a lighting module (instead of in the driver). For example, a PCB may be provided as part of the LED holder, which implements an NFC antenna and an NFC chip.

Figure 2:
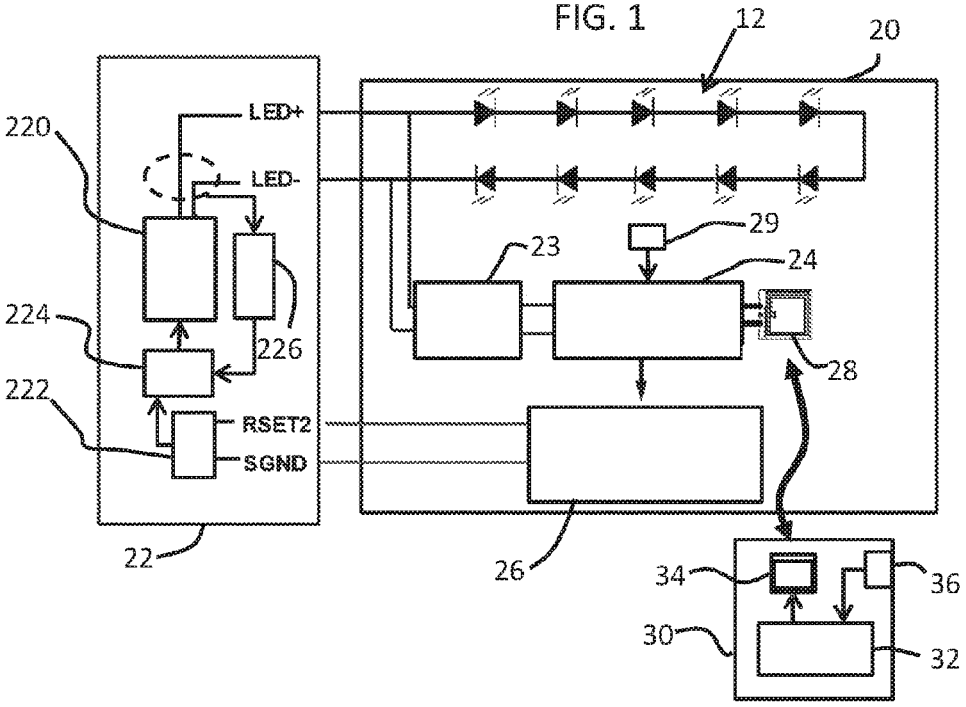
FIG. 2 shows a first example of LED module and driver together with an external interface device.

FIG. 2 shows a first example of a lighting module coupled to a driver 22, with a first interface type. The driver interface comprises terminals LED+ and LED− for the LED string, and a separate pair of terminals RSET2 and SGND for measuring the external current setting resistor in the light module. This is known as an RSET2 interface.

The driver 22 has a power unit 220 for providing power to the lighting module, and a sensing unit 222 for coupling to the resistor circuit for detecting the output resistance.

A controller 224 is used for controlling the power applied to the lighting module by the power unit 220 in dependence on the desired power conveyed by the detected output resistance. In more detail, the controller 224 should take the information on the desired power as a reference to determine the operation behavior of the power unit 220 to provide actual power in accordance with the desired power. In even more detail, if the driver is a closed loop feedback driver, the controller 224 should sense the actual power provided by the power unit and compare the actual power with the desired power, and in turn the error there between can be used for tuning the power unit 220 so as to reduce the error.

For this purpose, the controller of the driver may comprise a feedback loop independent from said resistor network, for sensing the actual light source drive signals provided by the power unit 220 to the lighting module and providing the sensed light source drive signals to the controller 224. This feedback path includes the current sensor 226 within the light module or alternatively within the driver. The controller 224 of the driver is then further adapted to control the light source drive signals provided by the power unit 220 according to the rated power of the lighting module and the sensed light source drive signals.

This provides a regulation of the power supply delivered to the lighting module.

These elements are standard parts of a conventional driver, and indeed the module of the invention is intended to be connectable to conventional drivers.

The LED module 20 comprises a power supply 23 which provides the power for a microprocessor 24. This power supply is tapped from the LED string. It may be tapped only from a portion of the LED string in order to minimize the power loss from the power supply. Alternatively, this power supply can be a more complicated switch mode power supply or a simple linear power supply.

The microprocessor 24 includes a near field communication integrated circuit (IC), in particular an NFC reader, which translates NFC commands into a signal for controlling a resistor circuit 26. The microprocessor 24 also functions as a control circuit for controlling a configuration of the resistor circuit 26 thereby to set the output resistance. The output resistance is defined between a ground terminal of the module SGND and a resistor output terminal RSET2. The near field communication signal is received using an antenna 28.

The resistor circuit 26 is an electronic circuit which is used to simulate a physical resistor that is used by the LED driver for current setting. The output resistance of the resistor circuit is conveyed to the connected driver 22 and encodes information about the desired power to be applied to the LED string.

The module optionally includes a temperature sensor 29 which may be used for setting a maximum temperature or for controlling the lifetime of the module as discussed below.

The NFC IC functions as a control interface for receiving configuration information from an external configuration device 30. The external configuration device provides configuration information which is received by the microprocessor 24. As shown, the external configuration device 30 comprises an NFC IC 32, in particular an NFC transmitter, and an antenna 34. A user interface 36 enables a user to select a desired output flux which is translated into a corresponding value of the resistor which is to be simulated by the resistor circuit 26.

The output resistance of the resistor network is independent of the light source drive signals from the connected driver 22 used to power the LED string. The desired output may be the rated power of the lighting module.

The control interface (i.e. the NFC receiver of the microprocessor 24) is adapted to receive the configuration information from the external configuration device 30 before the module is driven by the connected driver. This can be carried out by a customer before the lighting system is installed. The NFC communication can be used to set the desired flux lighting to the controller 24 using wireless power transfer from the external configuration device 30, with no other power provided to the module. In a real implementation, the NFC reader may comprise a power harvesting circuit to harvest enough energy to receive the NFC command and store the signal in a non-volatile RAM, even before the LED module is powered by the driver. After the LED module is powered by the driver, the microcontroller reads the signal in the RAM and set the output resistance of the resistor circuit. In this case, only when the driver is powered, does the resistor circuit need to be controlled.

Figure 3:
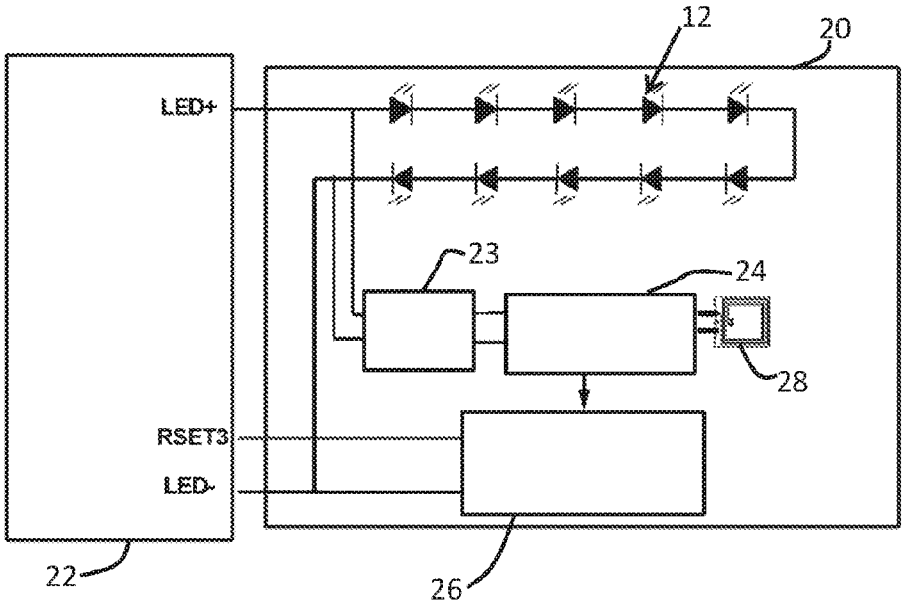
FIG. 3 shows a second example of LED module and driver.

FIG. 3 shows a second example of a lighting module coupled to a driver 22, with a second interface type. The module 20 includes the same components as in FIG. 2 and they are given the same reference numbers. The only difference is that the current setting resistor and the LED string 12 shares a common terminal such as the ground terminal. The temperature sensor is not shown, and the external configuration element is also omitted from FIG. 3.

The LED string is between terminals LED+ and LED−, and the setting resistor is between a light source terminal LED− and a resistor output terminal REST3. This is known as an RSET3 interface. The terminal LED− serves as the ground terminal for the resistor circuit 26.

The same module may function with both RSET2 and RSET3 drivers. For example the module of FIG. 2 with four output terminals may be used with the RSET3 driver of FIG. 3 simply by connecting the LED− and SGND terminals together, i.e. connecting two of the LED module connections to the single LED− driver connection.

The LED module circuit may be implemented in a small space provided by an LED holder.

The circuit is used to mimic a current setting resistor. The module is then programmed with a desired value of the current setting resistor, and it can be connected to any driver that has RSET2 or RSET3 functionality.

The invention enables an existing driver portfolio to be used, whilst still providing a simple user capability to set the desired output of the light engine.

The module may also implement a thermal function by including a temperature sensor which is used to adapt the simulated resistance value in dependence on the temperature level. This may be used to program the module to reduce its desired power to make it stay below a maximum temperature, which may for example enable implementation of a minimum lifetime.

The building blocks used in the module will now be described in further detail.

The power supply 23 is used to generate a power supply for the control circuit 24, such as 5V, from the LED+ and LED− module inputs or from a portion of the LED string. There are various possible circuits.

Figure 4:
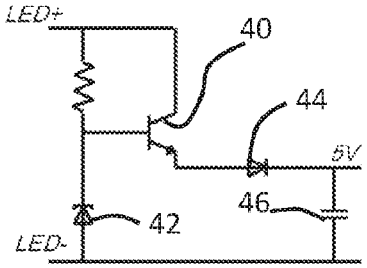
FIG. 4 shows a first example of power supply circuit.

FIG. 4 shows a first example which comprises a transistor circuit having an output transistor 40 coupled to the light source drive signals and a threshold element 42 in the form of a diode applied to the control terminal of the output transistor 40 thereby to set an output voltage of the output transistor as said power supply. The transistor is turned on and delivers current through a diode 44 to charge an output capacitor 46, until an output voltage is reached corresponding to the threshold element voltage less the base-emitter voltage drop. This embodiment is a typical linear power supply. It should be understood that other types of linear power supply are also applicable.

Figure 5:
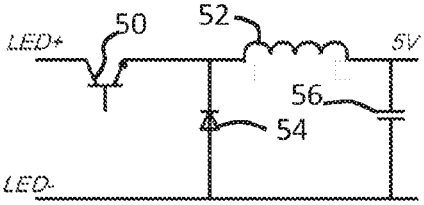
FIG. 5 shows a second example of power supply circuit.

FIG. 5 shows a second example based on a switch mode power supply circuit. The circuit comprises a switching transistor, an inductor 52 and a diode 54, in this example forming a buck converter. The output is provided across an output capacitor 56. It should be understood that other types of switched mode power supply such as boost and buck boost converter are also applicable.

A third example may be based on a voltage line in parallel with a certain number of solid state light sources. A forward voltage of the set number of solid state light sources then corresponds to a desired output voltage as the power supply. For example, two series 3.3V LEDs may be used to provide a 6.6V supply for the controller.

The resistor circuit comprises an electronic circuit used to generate a controllable output resistance in the view of the connected driver. There are various options for the resistor circuit, some of which are discussed below.

Figure 6:
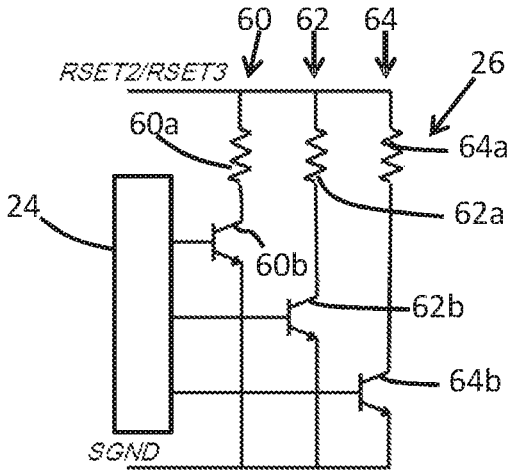
FIG. 6 shows a first example of resistor circuit.

FIG. 6 shows a first example in which the resistor circuit 26 comprises a set of resistor branches 60, 62, 64, each comprising a resistor 60*a*, 62*a*, 64*a* and a switch 60*b*, 62*b*, 64*b* in series. The branches are in parallel. The control circuit 24 is adapted to control the settings of the switches thereby defining the configuration of the resistor circuit.

The example of FIG. 6 gives 8 possible resistor settings.

Figure 7:
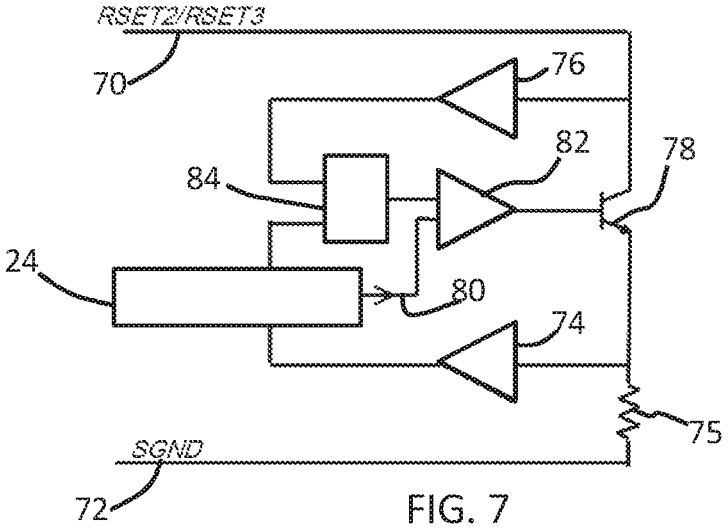
FIG. 7 shows a second example of resistor circuit.

FIG. 7 shows a second example in which the resistor circuit comprises first and second terminals 70, 72 for connection to the driver, wherein the resistor circuit comprises a current sensor 74 for sensing the current flowing between the first and second terminals (based on the voltage across a sense resistor 75), and a voltage sensor 76 for sensing the voltage between the first and second terminals. The control circuit 24 has a unit for calculating the equivalent resistance of the resistor circuit according to the sensed voltage and the sensed current.

The resistor circuit has a switching element 78 between the first and second terminals for controlling the equivalent resistance using the configuration information as well as the calculated equivalent resistance. The switching element is a transistor which has its output resistance controlled in a dynamic way. The controller 24 provides a desired resistance value 80 based on the current setting value as programmed into it, and a comparator 82 is used to compare this with a value generated by unit 84, to provide feedback control.

This approach is based on simulating the characteristics of a physical resistor. The switching element 78 provides dynamic control of the current and voltage levels so that the equivalent resistor becomes equal to the expected physical resistor.

Unit 84 is a divider element whose function is to provide a value of voltage/current (i.e. resistance). In a digital method, this could be implemented by a microcontroller, so that the unit 84 would not be required as a separate component.

Figure 8:
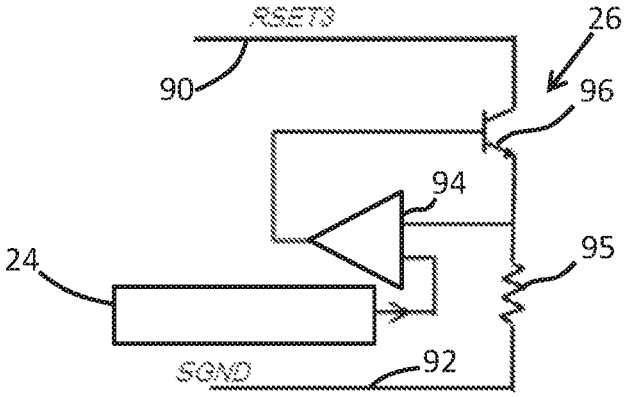
FIG. 8 shows a third example of resistor circuit.

FIG. 8 shows a third example in which the resistor circuit comprises first and second terminals 90, 92 for connection to the driver and for receiving a voltage, wherein the resistor circuit comprises a current sensor 94 for sensing the current flowing between the first and second terminals (based on the voltage across a sense resistor 95). The control circuit comprises a current control unit for controlling the current through the resistor circuit using the configuration information as well as feedback of the sensed current. The current is controlled using a switching element in the form of transistor 96.

This provides a controllable current source, which is specifically the input required by the RSET3 interface. The transistor is dynamically controlled to make the current is equal to that which a physical resistor would insert into the RSET3 port of the driver.

The module may be used with existing types of temperature overload protection. In this case, a thermal component (negative temperature coefficient—NTC) may be connected to the NFC IC. In the event of high temperatures, the circuit will signal to the driver that the module is at too high temperature and the driver can dim or shut down.

As mentioned above, temperature sensing may also be used to enable control of the lifetime of the module. Beyond a certain temperature, a lifetime of less than 50 khrs is predicted. If the customer, building a luminaire using the module, wants to apply the module in a limited heat sink luminaire, the power (current) must be reduced to meet this temperature. Instead of performing extensive testing, the NFC chip may be programmed to a particular lifetime such as 50 khr. The circuit can then internally compare a threshold value with the on-board thermal component, and if it exceeds the maximum temperature a lower drive current can be communicated to the driver.

The invention may be is used in a variety of lighting applications. The lighting modules may be indoor point sources, down lighting units or spot lighting units. The invention can also be used in linear LED applications (as used in offices), and also outdoor lighting for road and streets. In down lighting and office systems, often a well-defined flux is needed making an easy to implement flux setting highly desirable.

The invention has been described in connection with an LED lighting arrangement. However, it can be applied to a driver arrangement for other types of lighting technology. It can be applied to any driver which is adapted to communicate with an external sensing resistor for controlling the driver circuit configuration. For example, other solid state lighting technologies may be used.

The example above uses a NFC system to communicate the desired setting to the lighting module. This provides a convenient wireless operation for the user. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A solid state lighting module, comprising:

a solid state light source;

a resistor circuit, wherein an output resistance of the resistor circuit is for conveying to a connected driver information on a desired power to be applied to the solid state light source;

a control interface for receiving configuration information from an external configuration device; and a control circuit for controlling a configuration of the resistor circuit thereby to set the output resistance in response to received configuration information;

wherein the output resistance of the resistor circuit is independent of light source drive signals from the connected driver to power the solid state light source, and the control interface comprises a near field communication (NFC) receiver, comprising a near field communication (NFC) antenna and a near field communication (NFC) receiver circuit.

2. A module as claimed in claim 1, further comprising a power supply circuit for generating a power supply for the control circuit from light source drive signals received from the connected driver.

3. The module as claimed in claim 2, wherein the power supply circuit comprises:

a transistor circuit having:

an output transistor coupled to said light source drive signals and a threshold element applied to the control terminal of the output transistor thereby to set an output voltage of the output transistor as said power supply; or a switch mode power supply circuit; or a voltage line in parallel with a certain number of solid state light sources wherein a forward voltage of said certain number of solid state light sources corresponds to an output voltage as the power supply.

4. The module as claimed in claim 1, wherein the NFC receiver comprises a power harvesting circuit for generating a power supply for the control interface from a wireless signal received from the external configuration device.

5. The module as claimed in claim 4, wherein the output resistance is defined between:

a ground terminal of the module and a resistor output terminal; or a light source terminal of the module and a resistor output terminal.

6. The module as claimed in claim 5, wherein the resistor circuit comprises a set of resistor branches, each comprising a resistor and a switch in series, and the branches being in parallel, wherein the control circuit is adapted to control the settings of the switches thereby defining the configuration of the resistor circuit.

7. The module as claimed in claim 5, wherein the resistor circuit comprises first and second terminals for connection to the driver, wherein the resistor circuit comprises:

a current sensor for sensing the current flowing between the first and second terminals, a voltage sensor for sensing the voltage between the first and second terminals, and the control circuit comprises:

a unit for calculating the equivalent resistance of the resistor circuit according to the sensed voltage and the sensed current, and a switching circuit between the first and second terminals for controlling the equivalent resistance using the configuration information as well as the calculated equivalent resistance.

8. The module as claimed in claim 5, wherein the resistor circuit comprises first and second terminals for connection to the driver and for receiving a voltage, wherein the resistor circuit comprises:

a current sensor for sensing the current flowing between the first and second terminals, and the control circuit comprises a current control unit for controlling the current through the resistor circuit using the configuration information as well as feedback of the sensed current.

9. The module as claimed in claim 8, further comprising:

a temperature sensor for sensing temperature;

wherein the control circuit is adapted for controlling the configuration of the resistor circuit thereby to set the output resistance further in response to the sensed temperature.

10. The module according to claim 1, wherein the control interface is adapted to receive the configuration information before the module is driven by the connected driver.

11. The lighting module system comprising:

a lighting module as claimed in claim 10; and a configuration device for sending configuration information to the control interface of the lighting module, thereby to write a desired power setting of the lighting module therein.

12. The lighting circuit according to claim 11, wherein the desired power comprises the rated power of the lighting module.

13. The lighting circuit comprising:

a lighting module as claimed in claim 10; and the connected driver, wherein the connected driver comprises:

a power unit for providing power to the lighting module;

a sensing unit for coupling to the resistor circuit for detecting the output resistance; and a controller for controlling the power applied to the lighting module by the power unit in dependence on the information on the desired power conveyed by the detected output resistance.

14. The lighting circuit according to claim 13, wherein the driver comprises:

a feedback loop independent from said resistor network, for sensing the actual light source drive signals provided by the power unit to the lighting module and providing the sensed light source drive signals to the controller, wherein said controller of the driver is further adapted to control the light source drive signals provided by the power unit according to the rated power of the lighting module and the sensed light source drive signals.

* * * * *